US009637355B2

(12) United States Patent
Henkel et al.

(10) Patent No.: US 9,637,355 B2
(45) Date of Patent: May 2, 2017

(54) PROCESS AND SYSTEM FOR THE CALCULATION OF DATA FOR THE OPERATION OF A CRANE

(71) Applicant: Liebherr-Werk Ehingen GmbH, Ehingen (DE)

(72) Inventors: Joachim Henkel, Holzgünz (DE); Max Kenzelmann, Schelklingen (DE); Roland Bohnacker, Blaubeuren (DE); Oliver Ruoβ, Ehingen (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 0 days.

(21) Appl. No.: 14/734,482

(22) Filed: Jun. 9, 2015

(65) Prior Publication Data

US 2015/0375971 A1 Dec. 31, 2015

(30) Foreign Application Priority Data

Jun. 10, 2014 (DE) ..... 10 2014 008 604
May 29, 2015 (DE) ..... 10 2015 006 992

(51) Int. Cl.
*B66C 13/18* (2006.01)
*B66C 13/16* (2006.01)
(Continued)

(52) U.S. Cl.
CPC ..... *B66C 13/18* (2013.01); *B66C 13/46* (2013.01); *B66C 15/00* (2013.01); *B66C 23/905* (2013.01)

(58) Field of Classification Search
CPC ..... B60C 13/18; B60C 13/16; G05B 15/02
(Continued)

(56) References Cited

U.S. PATENT DOCUMENTS 4,178,592 A * 12/1979 McKee ..... G04B 47/00 340/407.1
4,185,280 A * 1/1980 Wilhelm ..... B66C 23/905 212/278
(Continued)

FOREIGN PATENT DOCUMENTS

DE 20 2004 008 083 U1 11/2005
EP 187 772 B1 6/1988
(Continued)

*Primary Examiner* — Marthe Marc-Coleman
(74) *Attorney, Agent, or Firm* — Dilworth & Barrese, LLP.

(57) ABSTRACT

The invention relates to a process for the calculation of relevant data for the operation of at least one crane, particularly of a mobile crane, whereby the system comprises at least one crane, a communication network, as well as a data processing center, whereby, first of all, one or more parameters of the crane are determined on the crane and these are transmitted to the data processing center through the communication network and, in the data processing center, one or more items of data that are relevant for the operation of the crane are computed and/or selected on the basis of the one or more parameters received from the crane and the relevant data computed and/or selected for the operation of the crane is transmitted back to the at least one crane, particularly to its crane control. Furthermore, the invention relates to a system for the calculation and/or selection of data relevant to the operation of at least one crane that is suitable for the implementation of the process in accordance with the invention.

17 Claims, 1 Drawing Sheet

(51) Int. Cl.

| | |
|---|---|
| ***G05B 15/02*** | (2006.01) |
| ***B66C 13/46*** | (2006.01) |
| ***B66C 15/00*** | (2006.01) |
| ***B66C 23/90*** | (2006.01) |

(58) Field of Classification Search
USPC ..... 701/50, 1; 700/275; 340/685; 703/7
See application file for complete search history.

(56) References Cited

U.S. PATENT DOCUMENTS 6,744,372 B1 * 6/2004 Shaw ..... B66C 13/44 212/276
8,825,313 B2 * 9/2014 Abel ..... B66C 13/18 212/282
2002/0013666 A1 * 1/2002 Schmid ..... B66C 23/905 702/42
2006/0028201 A1 * 2/2006 Morath ..... G01B 7/023 324/207.11
2008/0004898 A1 * 1/2008 Hubler ..... B66C 23/905 703/7
2008/0249679 A1 10/2008 Matsuda et al.
2012/0101694 A1 * 4/2012 Morath ..... B66C 23/905 701/50
2012/0312767 A1 * 12/2012 Bohnacker ..... B66C 13/46 212/276
2013/0024077 A1 * 1/2013 Abel ..... B66C 23/905 701/50
2013/0345938 A1 * 12/2013 Ruoss ..... B66C 23/905 701/50
2015/0375970 A1 * 12/2015 Eidenberger ..... B66C 13/46 212/312

FOREIGN PATENT DOCUMENTS

EP 1 868 150 B1 8/2011
EP 2 674 384 A1 12/2013

* cited by examiner

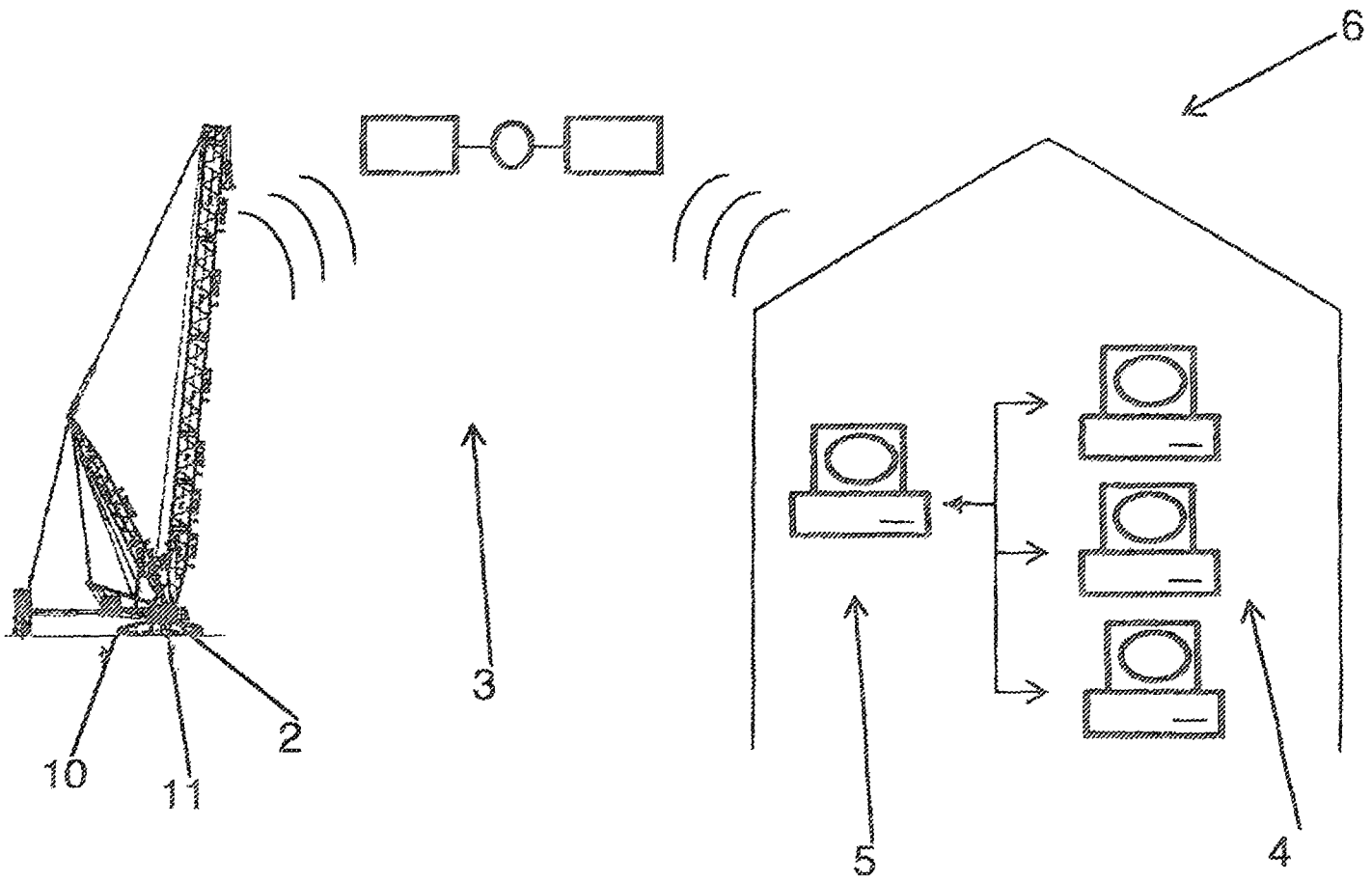
6
4
5
3
2
11
10

PROCESS AND SYSTEM FOR THE CALCULATION OF DATA FOR THE OPERATION OF A CRANE

BACKGROUND OF THE INVENTION

The invention relates to a process, as well as a system, for the calculation of the data relevant for the operation of the crane.

During its operation, a crane has a load torque limitation, which is intended to actively impede an excess load situation of the crane. An examination of the current bearing load against a permissible bearing load, which is determined in advance on the basis of stored values, usually occurs within the load torque limitation. Values specific to the crane and values stored in the crane, as well as order-specific values that specify the current equipment and environmental situation of the crane, or even normative specifications, for example, are thereby taken into consideration.

The computing capacity on a mobile working machine, like the memory storage units that already exist, must be constructed very sturdily, and also be constructed efficiently and be tested thoroughly in advance. The computing capacity and memory storage units are thus not to be compared with the values known from the area of home computing. The computation of the bearing load of a mobile crane and its boom systems, however, is a very computation-intensive task, which cannot be reasonably carried out during the service life of the crane by means of the computer resources available.

It is, therefore, a matter of the state of the art to store a bearing load table computed with external means and to refer back to the bearing load tables computed in advance during the operation of the crane. For that purpose, bearing load tables for all relevant combinations of the values specific to the crane and specific to the order are generally computed before beginning the operation of the crane and stored in the LMB [load torque limitation]. Because of the enormous quantity of data connected with that, it is not possible to compute bearing load tables corresponding to all conceivable combinations in advance. The best fitting bearing load table must thus be selected each time for scenarios not computed in advance. An interpolation onto the crane between two or more bearing load tables can also be avoided.

Efforts have already been made to carry out partial calculations on the crane and to optimize these. Non-computation-intensive calculations are also sometimes determined, however, with values for a permissible bearing load being computed in advance in the processing unit present on the crane and stored in the crane. The non-computation-intensive calculation of stability is thereby preferably carried out on the crane. The very expensive calculation of boom strength is computed in advance corresponding to the state of the art and stored retrievably on the crane by means of a memory storage unit.

It is true for all previous possibilities for solutions, however, that, because of the multiplicity of different parameters that are taken into consideration for a calculation of the bearing load tables, it is nearly impossible to make an individual bearing load table available for all different operating situations of the crane. The bearing load table used does not, consequently, form the specific operating conditions of the crane, so that inaccuracies in the determination of the permissible bearing load must be taken into account. For reasons of safety, a safety margin that takes these inaccuracies into account must thus be included for the load torque limitation. As the result of this, the bearing load that is actually possible cannot be completely utilized.

SUMMARY OF THE INVENTION

The task of the present invention consists of making an individual bearing load table optimized for the specific load lift available.

This task is solved by the process in accordance with the characteristics herein. Advantageous configurations of the process are the object of the description herein.

In accordance with the description herein, a process for the calculation of data relevant for the operation of at least one crane, particularly of a mobile crane, is proposed. The process is constructed on the basis of a system that consists of at least one crane and a communication network, as well as a data processing center.

In a first step, one or more parameters of the crane are determined on the crane, and these are transmitted to the data processing center through the communication network. These parameters are, in one particularly preferable manner, determined and transmitted during the set-up or operation of the crane.

Parameters are to be understood, for example, as those specific to the crane data that characterize the uniform characteristics of the crane and are, therefore, stored securely in the crane, particularly in the crane control unit. Such types of data are independent of the set-up level of the crane. The parameters can also, additionally or alternately, contain order-specific data, which are particularly directed at the current set-up level of the crane that is available. This data contains information about the components of the crane that has been prepared, such as about the physical characteristics of these components, for example, but also their position and condition.

After reception of the one or more parameters in accordance with the invention, a calculation of one or more items of data relevant to the operation of the crane is carried out in the data processing center on the basis of the one or more parameters received from the crane. The data relevant for the operation of the crane, such as whether the current crane safety can be guaranteed, for example, is to be understood as important control information that is required by the crane control during the operation of the crane. The parameters can be reported to the crane control by inputting by the crane operator, or else be determined by the sensors and/or processing unit present on the crane. Such data as is specific to or even necessary for the set-up process can also be understood to be relevant data for the operation of the crane. Data that is transmitted to the data processing center, computed there and, subsequently, transmitted back to the crane can accordingly also be used for the production of the usability of the crane. This data is then available to the crane control upon the setting up of the crane. The change-over mode of the crane, for example, can be monitored by this means.

The core idea in accordance with the invention accordingly proposes an outsourcing of the resource-intensive computation work for the calculation of one or more items of data relevant for the operation of the crane to an external data processing center, whereby this data is not to be computed, or not solely computed, before the beginning of the set-up or operation of the crane, however, but instead during the crane operation, preferably in real time. The computing capacity and power resources of a corresponding data processing center can be dimensioned at a distinctly higher and more efficient level, since the requirements for embedded control and processing units of a crane that are otherwise conventional do not have to be fulfilled.

After reception of the one or more parameters in accordance with the invention, a calculation of one or more items of data relevant for the operation of the crane on the basis of the one or more parameters received from the crane does not obligatorily take place in the data processing center. Alternately, the possibility exists that the calculation was already completed at an earlier point in time inside the data processing center, and the relevant data is thus already available in the data processing center. For example, if the calculation was only carried out after delivery of the crane, then the data could, for this reason, no longer be filed in the internal memory storage units in real time before the delivery of the crane, or it is simply not programmed in the crane. Upon a corresponding inquiry from the crane to the data processing center, the relevant data does not have to be computed in the data processing center upon the transmission of one or more parameters but, rather, only needs to be selected.

The one or more items of data relevant for the operation of the crane are subsequently transmitted back from the data processing center to at least one crane, particularly to its crane control, and are made available to the crane control for the regular pending operation of the crane. In particular, the data transmitted serve as input values for the crane control—i.e., the crane control uses the data received as input parameters for the subsequently following control routines.

All or nearly all of the steps necessary for the calculation of the one or more items of data relevant for the operation of the crane are preferably outsourced to the data processing center: but at the very least, however, those computation-intensive calculation steps for the calculation of one or more items of data that are relevant for the operation of the crane. Systems of equations with a high number of unknown values are preferably understood as computation-intensive calculation steps. The construction of a "rigidity matrix" in the data processing center can be noted as an example for a subsequent solution.

Information about the crane scaffolding, as well as the planned lift work, can additionally be considered to be possible order-specific values. Such values as the type of boom used—e.g., telescoping boom, lattice boom, peak boom or derrick boom with derrick ballast, etc., as well as the length of the boom—are among the information relating to the crane scaffolding. Furthermore, the order-specific values contain information about the crane accessories, the ballast, the crane support used or the possible crane rotational range. Far-reaching configuration possibilities are thus available, particularly in the boom system, since differently sized lattice parts can be combined in different lengths, for example, and the number of possible order-specific items of data to be supplied can, consequently, rapidly increase for an individual category.

Ideally, the external calculation of one or more items of data relevant for the operation of at least one crane occurs during the set-up or operation of the crane, so that, for every conceivable operating condition, current and individual items of data relevant for the operation of the crane are computed for the service life and can be made available to the crane control for the control of the individual sequences of movements of the crane.

Preferably, the one or more items of data relevant for the operation of the crane comprise at least one bearing load table, whereby this bearing load table can be transmitted directly from the data processing center to a load torque limitation (LMB) of the crane. The load torque limitation consequently receives the bearing load table received as an input value. It is conceivable for all calculation steps for the calculation of the bearing load table to be outsourced to the data processing center, but at the very least, however, the computation-intensive boom strength calculation and/or the stability calculation.

In addition to the parameters determined on the crane, i.e., those that are specific to the crane or order-specific crane data, normative specifications can additionally be transmitted to the data processing center. Such types of normative specifications are, for example, stored in the crane as a value or as a calculation formula and relate to the maximum permissible wind-exposed area of the load, for example. Such types of specifications can also play a role in the calculation of the bearing load table and are consequently preferably transmitted from the crane to the data processing center for the calculation of one or more items of data relevant for the operation of the crane.

An implementation of the calculation process in the data processing center as a so-called distributed system, with one or more centrally and/or non-centrally positioned and administered processing units that process partial tasks of a calculation request in parallel form, is possible. The selection of a standard adapted in a country-specific manner to the installation location of the crane, which is to be used for the calculation of the permissible bearing load, would also be possible.

For the case of a distributed application in the data processing center, it is appropriate to use at least one administration unit for the processing of the computation jobs received. Incoming calculation requests, especially complex computing requests from at least one crane, are analyzed by the administration unit and, optionally, divided into one or more partial calculations, and these are then distributed to the individual processing units of the distributed system. The individual results of the partial calculations are subsequently collected from the administration unit and transmitted from the administration unit of the data processing center to the requesting crane as a summarized final result. The data processing center for the crane is packaged as a single system or a computer. During the summary by the administration unit, additional computation steps for the further processing of the individual results upon need may be necessary.

In a distributed system, the processing of a less complex calculation request can also be processed by an individual computer processing unit.

Furthermore, it is conceivable that, among the parameters of the crane, supplemental data about the current environmental conditions will be transmitted to the data processing center for the calculation of the one or more items of data relevant for the crane. The current environmental conditions can, for example, involve information about the current inclination of the crane and the wind speed present, which can have considerable influence on the permissible bearing load of the crane in the current operating situation. A decisive gain in safety for the operation of the crane thereby comes about, since the current bearing load table can always be currently determined in dependence on the environmental conditions actually present. The crane consequently has less down time, since unnecessary inaccuracies and safety margins can be avoided.

Ideally, the parameters of the crane are recorded directly by the crane control or the load torque limitation and transmitted from this to the data processing center, on the basis of a suitable communications device. Alternately or optionally, it is conceivable for these parameters to not only be recorded by the crane control or the LMB unit itself and then transmitted, but instead, additionally or alternately, by an operational planning device constructed on the crane, which likewise receives access to the necessary parameters. In addition, it is conceivable for a mobile computer, which is positioned in the area of the crane and is connected with this in a communicating manner, to transmit the necessary parameters to the data processing center.

The back-transmission of the computed data relevant for the operation of the crane can take place directly on the crane or the crane control/LMB and optionally on the corresponding operational planning device of the crane or the mobile computer in the area of the crane.

Alternately, the components (crane, crane control, operational planning device, or mobile computer) can also exchange data received between themselves.

For logical reasons, all, or at least a portion, of the components providing support and acting with weight force installed on the crane can be monitored and measured by means of electronic identification, whereby the measuring signals can be transmitted to the data processing center as parameters of the crane.

The electrical identification, for example, can be carried out on the basis of a transponder solution. Other types of measuring systems are likewise conceivable. The system for electronic acquisition is in communicative connection with the crane control/LMB and/or the operational planning device and/or a mobile laptop in the area of the crane.

In accordance with an additional preferred embodiment, it can be provided, upon an inquiry from the crane to the data processing center, for not just relevant data corresponding to one or more transmitted parameters to be computed, but relevant data can, instead, be computed from the reception of one or more parameters, either simultaneously or promptly, on the basis of a slight modification. Within the data processing center, for example, a modified draft of the parameters can be taken as the basis for additional calculations, by way of "stock", in order to be able to prepare relevant data for future parameters in advance, for example, so that, for example, after the first transmission of the one or more parameters, simultaneously or promptly, from the crane to the data processing center, not only can bearing load tables be computed for the requested length of the boom, but the appropriate bearing load tables for the next stage of the length of the boom (shorter or longer) can instead likewise be computed. The length of the boom is noted here only as a selection by way of example of a possible parameter.

In addition to the process in accordance with the invention, the present invention additionally relates to a system for the calculation of data relevant to the operation of at least one crane, whereby the system in accordance with the invention consists of at least one crane, a data processing center, as well as a communication network. All components of the system are suitable for implementing the process in accordance with the invention or an advantageous configuration of the process. The advantages and characteristics of the system evidently correspond to those of the process in accordance with the invention, for which reason a repetitive description is dispensed with at this point.

It is conceivable for the system to comprise at least two or more cranes, whereby the computing order of a crane or the computed result is not made available only to the inquiring crane but, rather, to a group of cranes. This procedure can be more appropriate for more cranes on a construction site, for example.

In addition to the system, the invention additionally relates to a data processing center consisting of one or more centrally and/or non-centrally positioned processing units for the implementation of the process in accordance with the invention.

Furthermore, the invention relates to a crane, particularly a mobile crane, with a crane control, particularly an LMB, and communications devices for the implementation of the process in accordance with the present invention.

Finally, the invention relates to a software program stored on a data carrier for the implementation of the process in accordance with the present invention. It is conceivable that the software can be installed or implemented on a crane control and/or on a operational planning device and/or on a mobile computer in communicative connection with a crane and/or in a data processing center.

BRIEF DESCRIPTION OF THE DRAWING

Additional advantages and characteristics of the invention will be described in the following by means of an embodiment depicted in the single FIGURE.

DESCRIPTION OF THE PREFERRED EMBODIMENT

The single FIGURE depicts one possible scenario of the system in accordance with the invention, consisting of a mobile crane 10, a communication network 3, as well as the data processing center 6. The mobile crane has a crane control, particularly a load torque limitation, which has corresponding communications devices for communication with the data processing center 6 through the communication network 3.

The data processing center likewise comprises a communications device for communicative incorporation into the network 3. The connection that can be produced between the data processing center 6 and the crane 10 is bidirectional, so that data can be exchanged in both directions between the communications partners 6, 10. The transmission technology used is preferably radio-based, at the very least in parts, particularly, at the very least, between the crane 10 and a gateway of the communications network 3. Known standards, such as one of the mobile radio standards, are available here, but other suitable radio technologies that can also transmit the resulting data quantities reliably, safely and sufficiently rapidly between the communications partners 6, 10. The communication network 3 is regularly based on different networks with different transmission technologies, which are connected with one another by means of corresponding gateways.

In one memory storage unit of the crane 10, such as in the internal crane control/LMB 11, for example, values specifically programmed into the crane, which describe the fundamental crane type and its permanently installed crane components, are stored in memory. In addition, so-called order-specific data, which interact with the current set-up level of the crane that is present, among others, are present on the crane. The order-specific data contains general information about the type and the physical characteristics of the prepared components, e.g., about their physical weight, center of gravity, etc. These also include values that describe the current condition of these crane components, such as, the support base used, the length of the boom, the necessary balancing and angle of rotation, etc. Essentially all data that has a certain relevance for the computation of the bearing load is of significance.

Furthermore, the crane 10 stores in memory the normative specifications, which are either stored as values or as calculation formulas. Such specifications concern the maximum permissible wind-exposed area of the load for the lifting of attached load, for example. Such types of values/formulas can also have an influence on the calculation of the max. permissible bearing load.

If, during the set-up or the operation of the crane, the crane requires a bearing load table unknown to it, then it makes a corresponding inquiry to the data processing center 6. In addition, the crane 10 transmits the order-specific parameters that are specific to the crane and, optionally, normative specifications, in the form of values/formulas, to the data processing center 6, through use of its integrated communications device. This data transfer occurs very rapidly, since no calculations are carried out and only a transmission of data occurs. The data processing center 6 produces, on the basis of the parameters received, a computing order for the calculation of the bearing load table desired.

The structure of the data processing center 6 comprises either one or more processing units 4, which are positioned centrally at a specific point of the data processing center and process incoming computation jobs simultaneously.

Alternately or additionally, the structure of the data processing center 6 can also be constructed on the basis of so-called cloud computing. In this case, one or more processing units 4 are connected with one another as a distributed system through an internal communication network, in order for incoming computation jobs to be processed jointly in the form of partial calculations distributed over the units 4. The partial calculations necessary for the determination of a bearing load table consequently do not need to be processed sequentially by one single processing unit but, instead, processing can be carried out in parallel by distributed processing units, which leads to an appreciable increase in performance. The distributed computer processing units 4 do not necessarily have to be set up centrally at one location in the data processing center.

For the administration of the incoming computation jobs, the administration unit 5 is provided as a receiving point, which breaks the incoming computation jobs down into individual partial calculations, depending on possibility, and distributes these to the individual computer 4. Each computer reports its result back to the central point 5, which assembles an overall result from the several partial results and sends this, as an overall result, back to the ordering crane.

The result of the computing order is, as a general rule, a bearing load table, which can be transmitted very rapidly, as a purely static data file, from the data processing center 6 to the crane 10. In particular, this bearing load table is sent back to the LMB 11 of the crane 10 through the communication network 3.

An individual bearing load table optimized for the specific load lift, which can, during the set-up or the operation of the crane, be queried and updated at all times in real time, is now present on the crane 10. Furthermore, the current environmental conditions, such as the inclination of the crane, as well as the wind speed present at the operating site, for example, can also be included by means of the process in accordance with the invention. In addition, the crane 10 ensures that the data concerning these environmental conditions is, along with the parameters, made available to the data processing center, which includes the data upon the calculation of the bearing load table. This measure promotes the accuracy of the bearing load tables, since these can be approximated more precisely to the actually possible bearing load. The otherwise obvious safety margins can be reduced or even avoided, so that unnecessary down times of the crane can consequently be limited or even avoided entirely. This leads to a not insignificant improvement in the operating safety of the crane 10.

The implementation of the process given above can be carried out not only by the software of the crane control or LMB 11, but, rather, in other module programs 2, such as in the operational planning device on the crane 10 or on a mobile computer in the crane or the immediate environment of the crane 10, for example. Communication between the computer and crane 10 is additionally a presupposition for a mobile computer.

The recording of all or a portion of the components providing support and acting with weight force that are installed on the crane by means of electronic identification is advantageous. A suitable transponder apparatus, which reports the measured quantities specifically recorded on the component from the crane control through the communications interface, serves as a possible solution here.

After reception of the one or more parameters, a calculation of one or more items of data relevant for the operation of the crane on the basis of the one or more parameters received from the crane does not obligatorily occur in the data processing center 6. Alternately, the possibility exists that the calculation has already been completed inside the data processing center 6 at an earlier point in time and that the relevant data is thus already available in the data processing center 6. For example, if the calculation was carried out only after delivery of the crane 10, then the data could, for this reason, no longer be filed in real time before the delivery to the internal memory storage units of the crane 10, or it was simply not programmed into the crane 10. Upon a corresponding inquiry from the crane 10 to the data processing center 6, upon a transmission of one or more parameters, the relevant data does not need to be computed in the data processing center 6 but, rather, can only be selected and made available to the crane 10.

In this connection, it is conceivable that, for the preparation of crane units with similar set-up configurations, relevant data is already computed as "stock" inside the computer center 6 and, upon need, only needs to be recalled by the crane 10 or comparable cranes of a fleet of cranes. For example, after the first transmission of the one or more parameters from the crane to the data processing center, not only could bearing load tables be computed for the requested length of the boom, either simultaneously or promptly, but, rather, the appropriate bearing load tables for the next stage of the length of the boom (shorter or longer) could also be computed. The length of the boom is stated here only as an example of a possible parameter.

The greater amount of data thereby available additionally increases the probability that, upon an inquiry from an additional crane, an appropriate selection of relevant data will already be present in the data processing center and no new calculation will be necessary.

In this context, it would even be possible to deliver the crane after its manufacture with only a rudimentary set of relevant data (bearing load tables). The completeness of the data within the crane control is then produced only during the course of operation of the crane. If the memory storage capacities in the crane are limited, then it would also be possible to make a basic selection and, depending on the level of preparation or the operating system, the required bearing load tables can be loaded on the crane and used.

The invention claimed is:

1. A process for the calculation of relevant data for the operation of at least one crane, particularly of a mobile crane, with a system comprising at least one crane, a communication network, as well as a data processing center and memory, comprising the following steps:

crane-side determination of one or more parameters of the crane and transmission of the one or more parameters to the data processing center through the communication network, the data processing center is a distributed system of one or more centrally and/or non-centrally positioned processing units;

calculation and/or selection of one or more items of data relevant for the operation of the crane in the data processing center on the basis of the one or more parameters received from the crane; and transmission of one or more items of data relevant to the operation of the crane to the at least one crane, particularly to the crane control, wherein the data processing center comprises an administration unit which divides a calculation request of a crane into several partial calculations and distributes these to the several processing units, whereby the partial calculations are collected by the administration unit and summarized as one or more items of data relevant for the operation of the crane and sent to the at least one crane and/or makes the data already computer available.

2. A process in accordance with claim 1 wherein the one or more parameters determined on the crane comprise one or more values and/or order-specific values stored specifically in the crane, including values related to a set-up level of the crane that is present and/or normative specifications.

3. A process in accordance with claim 2, wherein the one or more items of data relevant to the operation of the crane comprise at least one bearing load table and transmit this to the load torque limitation of the crane.

4. A process in accordance with claim 3, wherein the process computes and makes available an individual bearing load table optimized for the a specific load lift of the crane.

5. A process in accordance with claim 4, wherein the data processing center is a distributed system of one or more centrally and/or non-centrally positioned processing units.

6. A process in accordance with claim 1 wherein the one or more items of data relevant to the operation of the crane comprise at least one bearing load table, which is transmitted to the load torque limitation of the crane.

7. A process in accordance with claim 6, wherein the process computes and makes available an individual bearing load table optimized for a specific load lift of the crane.

8. A process in accordance with claim 7, wherein the data processing center is a distributed system of one or more centrally and/or non-centrally positioned processing units.

9. A process in accordance with claim 1, wherein data supplemental to the parameters of the crane concerning the current environmental conditions is transmitted and is taken into consideration for the calculation of the one or more items of data relevant to the operation of the crane, whereby the data preferably involves, in the case of environmental conditions, information about a current inclination of the crane and/or a wind exposed area and/or a local wind profile about the level or the direction of wind and/or a wind speed and/or a construction recognized by optical and/or electronic devices and labels, particularly of transponders.

10. A process in accordance with claim 1, wherein the crane-side determination of the one or more parameters of the crane and the transmission of the parameters through the communication network to the data processing center is carried out by the crane control, particularly through the load torque limitation and/or through an operational planning device provided on the crane and/or a computer communicatively connected with the crane and located on an operating site.

11. A process in accordance with claim 1 wherein all or at the very least a portion of the components providing support and acting with weight force that are installed on the crane are determined by means of electronic identification and measuring signals are transmitted as the one or more parameters of the crane to the data processing center.

12. A process in accordance with claim 1 wherein an electronic recording is carried out by means of a transponder apparatus.

13. A process in accordance with claim 1 wherein in the data processing center, in addition to the relevant data computed or selected on the basis of the reception of one or more parameters, relevant data is computed simultaneously or promptly, as the case may be, on the basis of a slight modification of the reception of one or more parameters.

14. A system for the calculation and/or selection of relevant data for the operation of a crane comprising at least one crane, a data processing center, as well as a communication network for an implementation of the process in accordance with claim 1.

15. A data processing center comprising one or more centrally and/or non-centrally positioned processing units, preferably in the sense of a distributed system, for an implementation of the process in accordance with claim 1.

16. A crane, particularly a mobile crane, with a crane control, particularly load torque limitation, and communications devices for an implementation of the process in accordance with claim 1.

17. The process of claim 1, wherein the calculation of the one or more items of data relevant for operation of the crane are calculated by the data processing center, and the calculation occurs during a set-up of the crane and before beginning operation of the crane.

* * * * *